United States Patent [19]

Ishihara et al.

[11] Patent Number: 4,697,320

[45] Date of Patent: Oct. 6, 1987

[54] ROLL FOR A ROLLING MILL, METHOD OF PRODUCING THE SAME AND THE ROLLING MILL INCORPORATING THE ROLL

[75] Inventors: Joo Ishihara, Hitachi; Toshio Ogawa; Masashi Era, both of Katsuta; Ken-ichi Sato, Hitachi, all of Japan

[73] Assignee: Hitachi, Ltd., Tokyo, Japan

[21] Appl. No.: 625,591

[22] Filed: Jun. 28, 1984

[51] Int. Cl.[4] ..... B31B 31/08

[52] U.S. Cl. ..... 29/132; 241/228; 241/293

[58] Field of Search ..... 29/132; 241/228, 293

[56] References Cited

U.S. PATENT DOCUMENTS

| | | | |
|---|---|---|---|
| 3,779,720 | 12/1973 | Ellis et al. | 428/564 |
| 4,055,742 | 10/1977 | Brown et al. | 428/564 X |
| 4,137,106 | 1/1979 | Doi et al. | 29/132 X |

FOREIGN PATENT DOCUMENTS

| | | | |
|---|---|---|---|
| 90428 | 10/1983 | European Pat. Off. | 29/132 |
| 20161 | 2/1981 | Japan | 428/564 |
| 52462 | 3/1983 | Japan | 29/110 |
| 39767 | 3/1983 | Japan | 29/110 |

*Primary Examiner*—Timothy V. Eley

*Attorney, Agent, or Firm*—Antonelli, Terry & Wands

[57] ABSTRACT

A method of producing a long-life roll for a rolling mill manufacturing a rolled sheet having brightness. At least the surface of the roll barrel is made of steel containing carbide, the average grain size of which is not greater than 0.6 μm, and the areal ratio of the carbide in the matrix is 6–30%. The roll is manufactured by canning steel powder produced by an RST process into a metal cylindrical container in a vacuum, sintering the powder in the cylindrical container by hot isostatic pressing, working the sintered body into the cnfiguration of a roll by machining and further giving it a heat treatment and finishing work. The roll and a rolling mill incorporating the roll are also disclosed.

20 Claims, 4 Drawing Figures

ROLL FOR A ROLLING MILL, METHOD OF PRODUCING THE SAME AND THE ROLLING MILL INCORPORATING THE ROLL

BACKGROUND OF THE INVENTION

This invention relates to a roll for rolling metals such as steel, aluminum and copper, a method of manufacturing the roll and a rolling mill incorporating the roll.

This invention is especially suitable for producing metal sheets having brightness, such as, for example, a stainless mirror plate in an oilstove or an aluminum foil.

Brightness is often required for a rolled sheet of steel, aluminum, copper, steel alloy, aluminum alloy or copper alloy. A rolled sheet having brightness is used as a mirror plate, a reflector plate and the like.

Previously, a roll produced by working an ingot of tool steel, high speed steel or the like has been employed for producing a rolled sheet. However, when, for example, rolling is conducted with such rolls a stainless steel, the roll can only stand a continuous use for a short time period of, for example, 10–15 minutes, and the length of sheet capable of being continuously rolled during such time period is about 1,000 m at the maximum. A longer use of the roll seriously deteriorates the brightness of the rolled sheet. Therefore, it is necessary to stop the run of the rolling mill to recondition the rolls when rolling has been conducted for 10–15 minutes in terms of rolling time and 1,000 m by the length of the rolled sheet. The time required for reconditioning the rolls is several times as long as the time of continuous rolling.

In, for example, Japanese Patent Publication No. 35874/79, a method of producing a Sendzimir roll by sintering steel powder has been proposed using high carbon and high vanadium steel powder produced by a water atomization process or a gas atomization process. However, it has not reported nor described in the Japanese Patent Publication that brightness of a rolled sheet could be heightened by using a sintered powder roll.

SUMMARY OF THE INVENTION

Accordingly it is an object of this invention to provide a long-life roll suitable for producing a rolled sheet having brightness.

It is another object of this invention to provide a method of producing a novel roll capable of being continuously used for longer period of time as compared with a roll made of ingot or a conventional sintered powder roll.

It is a still another object to provide a rolling mill incorporating a roll according to this invention.

According to this invention, whole or at least a surface of a barrel of a roll is composed of a steel, in which the mean grain size of carbides is not greater than 0.6 μm, and the areal ratio of the carbide in the matrix is 6–30%.

Investigations were conducted as to the reasons why the brightness of a rolled sheet is lost with the increase in the rolling time when rolled by a roll made of a steel having a large carbide content such as tool steel or high speed steel.

As a result of the investigations, it was found that the brightness is impaired because, with the increase in rolling time, the surface of a roll is worn and becomes rough as the amount of wear of the matrix is larger than that of the carbides, and this roughness is transferred to a rolled sheet. The carbides finally fall off the roll surface with the wear of the matrix, and the next carbides come to the surface and fall off repeatedly in same manner.

While the roughness of the roll surface could be avoided by excluding carbides from the structure of roll, a roll containing no carbides is susceptible to local wear due to a difference in a radial load since the roll is not uniformly loaded and the radial load varies along the axis of the roll, due to the deflexion of the roll, a catching of any foreign matter between the rolls or the like thereby deteriorating the brightness. Therefore, what is important is to avoid extreme roughness on the surface of the roll made of an alloy containing carbide.

The reflectivity of a rolled sheet was measured, an examination was conducted to determine the relationship between reflectivity and brightness and the relationship between reflectivity and surface roughness of the rolled sheet, and the influence of the roll surface roughness on the surface roughness of the rolled sheet.

It was found that, in order to give a good impression of brightness to human eye, it is necessary to provide a reflectivity of 50% when a light of 0.7 μm wavelength shines on a horizontally placed rolled sheet from above at an angle inclined by 5° in relation to the vertical axis.

It was also found that to obtain a reflectivity of higher than 50% it is necessary to limit the surface roughness of a rolled sheet to less than 0.1 μm, and, therefore to limit the surface roughness of a roll to less than 0.3 μm. To make the surface roughness of a roll less than 0.3 μm, no carbides more than 0.3 μm in height should project above the roll surface.

In a roll made of ingot or powder, carbide is in a spherical or nearly spherical shape; therefore it falls off when half of the grain diamter of carbide projects above the roll surface. This means that the grain size of carbide should be less than 0.6 μm so as to limit the height of the carbides projecting above the roll surface to less than 0.3 μm.

On the other hand, as there are cavities left on the roll surface from which carbides have fallen off, the deterioration of brightness caused by the transference of the cavities to a rolled sheet should also be taken into consideration. Nevertheless, it was found that cavities less than 0.3 μm deep are refilled during rolling without being transferred to a rolled sheet. Since the rolled sheet is transformed while sliding on the roll surface, shallow cavities are refilled at this time.

Since in a conventional roll made by working an ingot the carbides with a grain size of several μm to several tens of μm occupy the majority, the height of carbides projecting above the roll surface due to the wear of the matrix is much greater than 0.3 μm.

In a roll made of steel powder produced by the water atomization process or the gas atomization process, the carbides with a grain size of the order of several μm occupy the majority, and so the height of the carbides projecting above the roll surface is greater than 0.3 μm. In addition, the powder produced by the water atomization process contains a large amount of oxygen which tends to produce blow hole in a roll.

The areal ratio of carbide is an important factor for the prevention of degradation of brightness of a rolled sheet due to a local wear of a roll surface. Making the areal ratio of carbide more than 6% can remarkably reduce the deterioration in brightness of a rolled sheet due to a local wear of a roll surface. There is a marked difference in the length of a bright sheet capable of being rolled before reconditioning of the roll, between a roll containing 6% carbides by areal ratio and a roll containing 5% carbides by areal ratio.

If the areal ratio of carbides exceeds 30%, the material becomes brittle thereby causing the breakage or fracture of the roll. Another problem is encountered in production of the powder. That is, when the content of vanadium carbide, tungsten carbide or molybdenum carbide in molten metal exceeds 30% by volume, a state wherein primary carbide floats in molten metal occurs thereby making it difficult to homogenize the molten metal. When powder rolls were produced from such molten metal by the atomization process, the floating carbide existed in the powder as coarse carbide with a grain size of more than 10 μm after the molten metal was solidified. A roll made of such powder impairs the brightness of a rolled sheet.

Carbides which solely consist of grains having a grain size of less than 0.6 μm are most desirable. However, if the mean grain size of carbides is less than 0.6 μm, the rolled length of the rolled sheet having brightness can be increased by more than that obtainable by a conventional roll made of ingot or atomized powder.

It is desirable that the carbides with a grain size of 0.6 μm occupy more than 80% of the areal ratio of carbide.

The hardness of carbide is also an important factor for retarding the progress in wear of a roll and preventing any local wear. It was found that carbides with a hardness of greater than Hv (Vickers hardness number) 1,700 scarcely wear even when rolling a stainless steel, and a roll having these carbides retards the progress in wear. Additionally, it was found that a roll in which the hardness of the carbides is greater than Hv 1,700 or a roll in which a majority of the carbides (preferably more than 80% of the total amount of carbides) have a hardness higher than Hv 1,700 is not susceptible to a local wear.

Both vanadium carbide and tungsten carbide have hardness of greater than Hv 1,700. For example vanadium forms carbide in the form of VC, which exhibits a hardness of Hv 2,700–2,800. On the other hand, tungsten forms carbide in the form of $(Fe, W)_6C$ with a hardness of Hv 1,700–2,100.

Chromium forms, in dependence on its content, carbide in the form of $(Fe, Cr)_{23}C_6$ or $(Fe, Cr)_7C_3$. $(Fe, Cr)_{23}C_6$ has a hardness of Hv 1,500–1,600, while $(Fe, Cr)_7C_3$ a hardness of Hv 2,300–2,400. Accordingly, it is desirable that the roll contains VC, $(Fe, W)_6C$ or $(Fe, Cr)_7C_3$.

Since carbides come out of the matrix due to the slippage of a sheet being rolled, the carbides fall off the surface of a roll. The softer the material of a matrix, the more rapid is the progress of the falling off of carbides and, hence, the wear of a roll. It is desirable to make the hardness of a steel greater than Hv 491 (Rockwell hardness $H_{RC}$ 48) in order that carbides may not easily fall off the surface of a roll.

According to the invention, at least the surface of the barrel of a roll is preferably composed of a steel wherein at least one selected from the group consisting of chromium carbide, tungsten carbide and vanadium carbide is dispersed in the matrix of a martensite structure. Martensite structure is selected because it strengthens and gives toughness to the matrix. Chromium forms carbides and a part of the carbides dissolves into the matrix during hardening process thereby improving the hardenability and making it easy to transform the matrix into martensite. Therefore it is most important to contain chromium.

Carbides are not limited to chromium, vanadium and tungsten carbides mentioned above but, for example, molybdenum carbide may be included.

Martensite matrix contains dissolved carbon and at least one of silicon and manganese which are added as deoxidizers in the steel making process. Too large content of silicon or manganese makes a material brittle, so that its content preferably ranges between 0.1–1 wt%. The dissolved carbon content in the matrix preferably does not exceed 0.5 wt%.

The roll of this invention may be an integral roll made of only one type of steel or a composite roll made of two or more types of materials. When a roll is a composite roll, it should have a layer of steel containing 6–30% carbides by areal ratio at least in the surface of the barrel.

As a method of making a composite roll, a process of spraying a steel containing the above-mentioned carbides onto the surface of core material, or a process of inserting a core material into a sleeve made of the steel containing the above-mentioned carbides and then fitting them by shrink fit or expansion fit can be used.

The thicker the layer sprayed on the surface of a core material, the greater the effect of the sprayed layer. The thickness should be at least 1 mm, preferably more than 3 mm. A roll having sprayed layer with thickness of 1 mm enables continuous rolling over a length of 3,000 m in rolling a stainless steel.

Although any desired material can be used as a core material, steel is preferable in consideration of material cost and strength.

A layer consisting of a steel in which the mean grain size of carbide is not greater than 0.6 μm and the areal ratio of carbide in the matrix is 6–30% can be made using steel powder prepared by a Rapid Solidification Technology process (hereinunder "RST process"). The smaller the grain size of powder, the better the result that may be obtained and, in particular, the grain size should not be greater than 0.64 mm (28 mesh in ASTM).

The RST process is a process comprising the steps of spouting molten metal onto a disk rotating at high speed thereby dispersing it around as liquid particles and rapidly cooling the particles by a jet of an inert gas directed thereto, with all of these processing steps are conducted in a vacuum.

In the steel powder obtained by this process, dendritic carbide exists, but this carbide is fissioned into grains with a nearly spherical shape by a subsequent annealing. The grain size of powder may differ with the rotation speed of the disk and the jetting velocity of the inert gas, while the grain size of carbide in the powder differs with the grain size of powder and the temperature and time of annealing. Generally, however, carbide with grain size of not greater than 0.6 μm can be easily produced. All the carbides in the powder have nearly same grain size and are almost evenly distributed. The oxygen content in the powder can be decreased to 100 ppm or below.

The disk rotation speed preferably ranges between 10,000 and 30,000 rpm, and the annealing temperature ranges between 800° and 900° C. As an inert gas, helium, argon, nitrogen or the like can be used. In the case of using helium, the jetting velocity is desirable to be about 1,000 m/s.

An integral roll made of only one kind of steel can be produced by canning steel powder prepared by the RST process into a metal cylindrical container in a vacuum, sintering the powder in the cylindrical container by hot isostatic pressing, working the sintered material into the configuration of a roll by machining and further subjecting it to a heat treatment and finishing work.

By hot isostatic pressing the dendritic carbide in the powder produced by the RST process can be fissioned. Therefore, in a method of manufacturing a roll which uses the hot isostatic pressing, an extra step of annealing for the fission of dendritic carbide is not necessary.

Any material may be used for a cylindrical container for containing powder if it is not broken by pressing and, for example, a steel material may be used.

The machining after hot isostatic pressing is conducted by cutting, with a cutting tool, the sintered powder body together with the cylindrical container, or after being taken out of the cylindrical container.

The sintered powder body worked into the configuration of a roll is next subjected to a heat treatment which preferably consists of hardening and tempering. The temperature of hardening and tempering varies with a roll material. In the case of a steel which has 6–30% by areal ratio of carbides of chromium, tungsten and vanadium dispersed in the matrix of martensite structure, the desirably hardening temprature is in the range of between 900°–1,300° C.

As the heat treatment deforms the roll more or less by thermal strain, the heat treated roll is subjected to a finishing work by a cutting tool. It is desirable that the surface roughness of roll barrel after finishing work be less than 0.3 μm.

Cold isostatic pressing can be applied in place of hot isostatic pressing, although in this case an extra step of annealing the powder produced by the RST process is necessary. The step of annealing is desirably conducted before the step of cold isostatic pressing.

Further, when the green powder compact obtained by cold isostatic pressing is sintered, since the density of the sintered body is lower than that of the sintered body obtained by hot isostatic pressing and pores tend to be produced in the sintered body, it is necessary to forge the sintered body thereby increasing its density. The forging may be either hot forging or cold forging. The sintered body may be forged either contained in the cylindrical container or after being taken out of of the container.

A composite roll is manufactured, for example, by forming a sprayed layer of the steel powder produced by the RST process on the surface of a steel core material and canning the core material with the sprayed layer into a cylindrical container in a vacuum and pressing the same by the hot isostatic pressing. After pressing, machining are predetermined heat treatment and applied in the same way as with an integral roll made of only one kind of steel.

The steel powder produced by the RST process may be sprayed onto the surface of the core material after spheridizing the carbides by an annealing treatment. In this case, either hot or cold forging may be applied instead of hot isostatic pressing.

As a process of spraying, for example, plasma spraying may be applied.

In another example of a method of manufacturing a composite roll, the steel powder produced by the RST process is canned, in a vacuum, into a metal cylindrical container with a steel core material arranged in the center, and the cylindrical container is pressed by the hot isostatic pressing to obtain a blank with a sintered powder layer formed on the surface of core material. This blank is next forged and subjected to a machining and heat treatment in a same manner as in the case of an integral roll made of only one kind of steel. The thickness of the sintered powder layer in the roll after the finishing work is preferably 1 to 50 mm.

A roll according to the invention can be used as a roll for hot rolling or cold rolling. Especially it is desirable to be used as a work roll for a cold rolling mill, because it is the final rolled sheet that is required to have brightness.

A roll according to the invention can be used as either or both of a pair of work rolls for a hot or cold rolling mill depending on whether the surface requiring brightness is a single or both surfaces of the rolled sheet.

A Sendzimir rolling mill having a pair of work rolls and a plurality of back-up rolls in support of respective work rolls is often used for manufacturing a thin strip of a stainless steel by cold rolling. The roll of the invention is suitable for use as a work roll of such Sendzimir rolling mill.

These and other objects as well as advantages of the present invention will become clear by the following description of a preferred embodiments of the present invention with reference to the accompanying drawings wherein:

DESCRIPTION OF PREFERRED EMBODIMENTS

Example 1

Roll of a steel having the composition shown in Table 1 was manufactured by two kinds of methods.

In one method, the roll was manufactured by making an ingot, forging, machining by a cutting tool, hardening and tempering, and then giving finishing work by a cutting tool. In this roll, the carbides with a grain size of several μm, occupied the majority of the carbides which were distributed on the surface and the mean grain size was about 5 μm.

In the other method, the roll was manufactured using the powder produced by the RST process. More specifically the steel powder was canned into an iron cylindrical container in a vacuum of $10^{-4}$ mm Hg, and pressed and sintered by the hot isostatic pressing with the opening of the cylindrical container sealed by welding. The hot isostatic pressing was conducted at a temperature of 1,100° C. and under a pressure of 1,500 Kg/cm$^2$ for three hours. After the pressing, the sintered body was taken out of the cylindrical container, cut with a cutting tool to be formed into a roll with a diameter of 100 mm and a length of 300 mm, hardened, tempered and cut again with the cutting tool to make a final surface roughness of about 0.3 μm. Four different types of rolls with different carbide grain sizes were prepared by this method. The grain sizes of the carbides were adjusted by changing conditions of the RST process. The mean grain sizes were 0.6 μm, 0.7 μm, 1 μm and 2 μm, respectively, and no coarse carbide substantially exceeding the mean grain size was detected. In a roll in which the mean grain size of carbides was 0.6 μm, the maximum grain size of the carbides was not greater than 1 μm.

Each roll was hardened and tempered under the same conditions, namely at a hardening temperature of 1,230° C. and a tempering temperature of 580° C. The hardness of each roll was about $H_{RC}$ 62.

TABLE 1

| No. | Composition (wt %) | | | | | | | | | Areal ratio of carbide |
|---|---|---|---|---|---|---|---|---|---|---|
| | C | Si | Mn | P | S | Cr | W | V | Fe | |
| 1 | 1.58 | 0.41 | 0.51 | 0.031 | 0.027 | 4.20 | 8.53 | 5.44 | bal. | 11% |

A stainless steel was rolled with above-mentioned each roll used as a work roll of a Sendzimir rolling mill, and light reflectivity was measured on each of the rolled sheet obtained.

The reflectivity was measured by shining a light of 0.7 μm wavelength on a horizontally placed rolled sheet from above at an angle inclined by 5° C. to the vertical axis.

Figure 1:
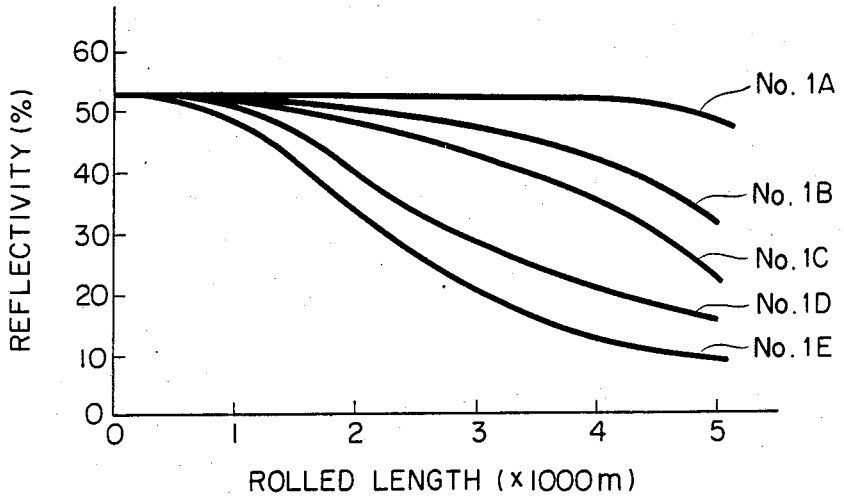
FIGS. 1 to 4 are characteristic graphs illustrating the relationship between rolled length and reflectivity of a sheet rolled by the roll disclosed in respective Examples.

The relationship between reflectivity and rolled length for example 1 is shown in FIG. 1.

Sample No. 1A is a roll according to the invention in which the mean grain size of the carbides is 0.6 μm. The rolled sheet obtained by this roll exhibited the reflectivity of higher than 50% when the rolled length is 4,000 m. Sample No. 1B is a roll in which the mean grain size of the carbides is 0.7 μm, and No. 1C, No. 1D and No. 1E are rolls in which the mean grain sizes are 1 μm, 2 μm and 5 μm, respectively.

Example 2

Integral rolls of a steel respectively having the composition shown in Table 2 were manufactured using the powder produced by the RST process in accordance with a method similar to that in Example 1.

TABLE 2

| No. | Composition (wt %) | | | | | | | | | Areal ratio of carbide |
|---|---|---|---|---|---|---|---|---|---|---|
| | C | Si | Mn | P | S | Cr | W | V | Fe | |
| 2 | 1.38 | 0.27 | 0.36 | 0.024 | 0.021 | 0.87 | 4.55 | — | bal. | 12% |
| 3 | 1.58 | 0.41 | 0.50 | 0.031 | 0.027 | 4.20 | 3.53 | 5.44 | bal. | 11% |

The mean grain sizes of the carbide of both rolls No. 2 and No. 3 were 0.6 μm. Roll No. 2 was hardened at a temperature of 850° C. and tempered at 150° C. In the case of roll No. 3, the hardening temperature was 1,230° C. and the tempering temperature was 550° C. It was in order to make the hardnesses of both rolls No. 2 and No. 3 about $H_{RC}$ 62 that the hardening temperatures were changed.

Roll No. 2 had carbides in the form of $(Fe, Cr)_{23}C_6$ and $(Fe, W)_6C$. The carbides in roll No. 3 were mainly in the form of VC and $(Fe, W)_6C$.

Rolls Nos. 2 and 3 were incorporated in a Sendzimir rolling mill as a work roll as in Example 1 and light reflectivity was measured on the rolled sheets obtained by these rolls. The method of measuring light reflectivity was same as in Example 1.

Figure 2:
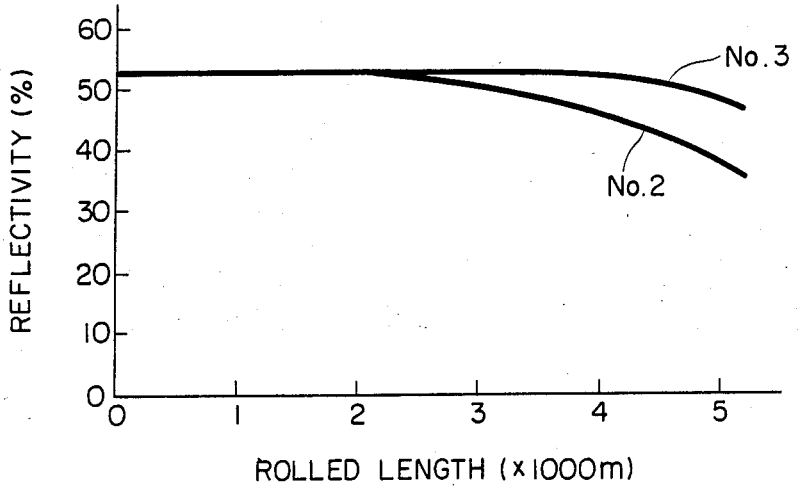

FIG. 2 shows the relationship between reflectivity and rolled length for the example 2. Roll No. 2 exhibited greater rolled length than rolls No. 1B–No. 1E, but was inferior to roll No. 3. Roll No. 3 exhibited the reflectivity of higher than 50% even after a continuous rolling over 4,000 m.

Example 3

An integral roll of a steel having the composition shown in Table 3 was manufactured using the powder produced by the RST process in accordance with a method similar to that in Example 1.

The hardening temperature was 950° C. Tempering was conducted at a temperature of 530° C., 500° C. and 400° C. to obtain rolls with a hardness of $H_{RC}$47, 48 and 55, respectively. The carbides were in the form of $(Fe, Cr)_7C_3$, the mean grain size was 0.6 μm, and the areal ratio was 15%.

TABLE 3

| No. | Composition (wt %) | | | | | | | Areal ratio of carbide |
|---|---|---|---|---|---|---|---|---|
| | C | Si | Mn | P | S | Cr | Fe | |
| 4 | 2.25 | 0.44 | 0.50 | 0.015 | 0.020 | 12.03 | balance | 15% |

Each of the rolls was incorporated in a Sendzimir rolling mill as a work roll and a stainless steel was rolled. Light reflectivity was measured on the rolled sheets obtained. The method of measuring reflectivity was same as in Example 1.

Figure 3:
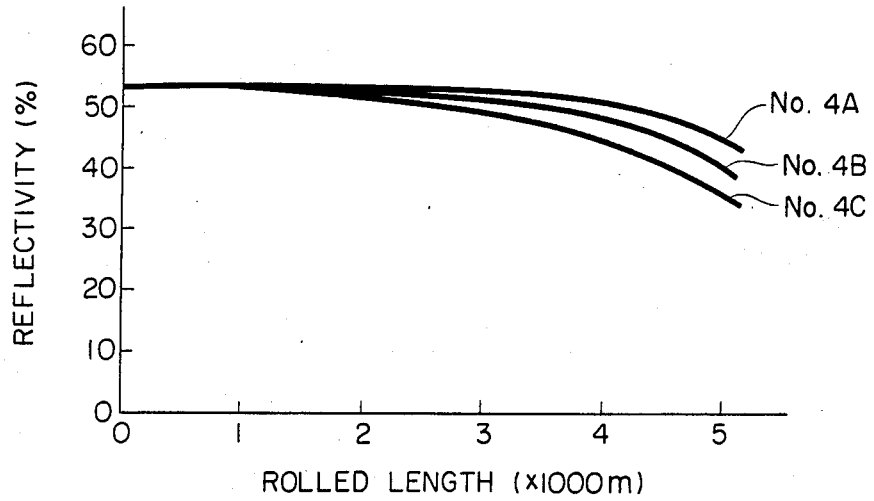

FIG. 3 shows the relationship between reflectivity and rolled length for the example 3. No. 4A is a roll with a hardness of $H_{RC}$55, No. 4B is a roll with a hardness of $H_{RC}$48 and No. 4C is a roll with a hardness of $H_{RC}$ 47. It is obvious that the rolled length can be lengthened with the increase in hardness of a roll. No. 4A provides the reflectivity of higher than 50% even when the rolled length is 4,000 m.

Example 4

Integral rolls of a steel respectively having the composition shown in Table 4 were manufactured using the powder produced by the RST process in accordance with a method similar to that in Example 1.

TABLE 4

| No. | Composition (wt %) | | | | | | | | | Areal ratio of carbide |
|---|---|---|---|---|---|---|---|---|---|---|
| | C | Si | Mn | P | S | Cr | W | V | Fe | |
| 5 | 1.55 | 0.38 | 0.49 | 0.028 | 0.025 | 4.37 | 5.14 | 5.52 | balance | 6% |
| 6 | 0.29 | 0.25 | 0.31 | 0.023 | 0.026 | 2.59 | 9.42 | 0.34 | balance | 5% |

The hardening temperature of roll No. 5 was 1,250° C. and that of roll No. 6 was 1,050° C. Roll No. 5 was tempered at a temperature of 620° C. and No. 6 at 550° C. The hardness of $H_{RC}$ 56 was obtained for both of rolls Nos. 5 and 6.

The carbides in roll No. 5 were mainly in the form of VC and $(Fe, W)_6C$ and those in roll No. 6 were mainly in the form of $(Fe, W)_6C$. The mean grain size of the carbides in both rolls No. 5 and No. 6 was 0.6 μm.

A stainless steel was rolled with those rolls incorporated in a Sendzimir rolling mill as work rolls. Light reflectivity was measured on the rolled sheets obtained. The method of measuring reflectivity was same as in Example 1.

Figure 4:
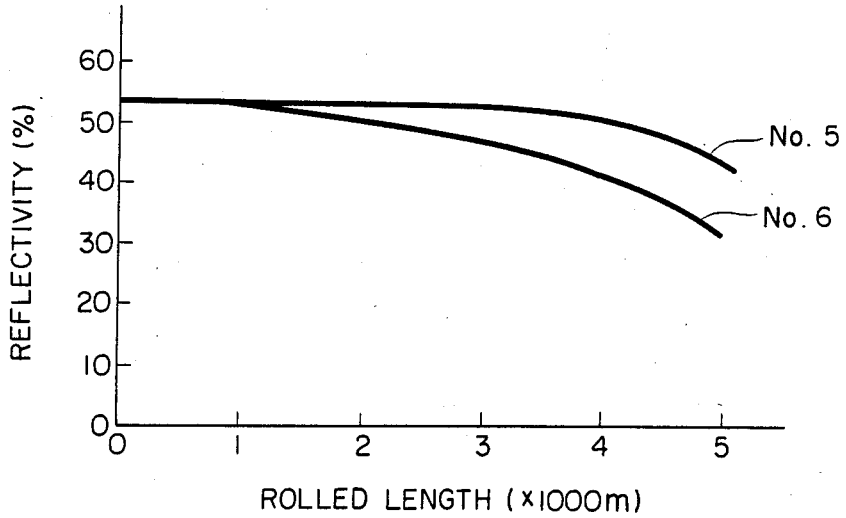

FIG. 4 shows the relationship between rolled length and reflectivity of example 4. Roll No. 5 having a carbide areal ratio of 6% suffered only a small deterioration in reflectivity and exhibited the reflectivity of higher than 50% even after a 4,000 m continuous rolling. In contrast, roll No. 6 having a carbide areal ratio of 5% experienced a quick deterioration in reflectivity. This clearly tells that the areal ratio of the carbides on the surface of a roll should not be less than 6% in order to obtain brightness of a rolled sheet over a long rolled length.

As described above, a roll according to this invention makes it possible to obtain a rolled sheet having brightness over a long rolled length.

What is claimed is:

1. A roll for a rolling mill comprising a barrel including a barrel surface made of steel containing carbide dispersed in a matrix having a martensite structure, characterized in that a mean grain size of said carbide is not greater than 0.6 μm, and an areal ratio of said carbide in the matrix lies in a range of 6–30%.

2. A roll for a rolling mill according to claim 1, wherein the greatest grain size of said carbide is not greater than 10 μm.

3. A roll for a rolling mill according to claim 1, wherein hardness of said steel containing carbide is higher than Hv (Vicker hardness number) 491.

4. A roll for a rolling mill according to claim 1, wherein hardness of said carbide is higher than Hv 1,700.

5. A roll for a rolling mill according to claim 1, wherein whole part of said roll is made of said steel containing carbide.

6. A roll for a rolling mill according to claim 5, wherein said roll is made of a sintered powder roll.

7. A roll for a rolling mill according to claim 1, wherein the barrel surface of said roll is composed of a steel containing at least one of chromium carbide, tungsten carbide and molybdenum carbide dispersed in a matrix of martensite structure.

8. A roll for a rolling mill, characterized in that the roll includes a barrel surface composed of a steel consisting essentially of carbon, at least one of silicon and manganese, at least one of chromium, tungsten, vanadium and molybdenum, and the balance substantially iron, and further having a structure wherein at least one of chromium carbide, tungsten carbide, vanadium carbide and molybdenum carbide is dispersed in a matrix having a martensite structure, and in that a mean grain size of said carbide is not greater than 0.6 μm, and a areal ratio of said carbide in the matrix lies in a range of 6–30%.

9. A roll for a rolling mill according to claim 8, wherein said silicon and said manganese are contained in an amount of 0.1–1 wt%, respectively.

10. A roll for a rolling mill according to claim 8, wherein said carbide is substantially composed of at least one of $(Fe, Cr)_7C_3$, $(Fe, W)_6C$ and VC.

11. A roll for a rolling mill composed of a steel core material covered with a layer of steel containing carbide, characterized in that at least the barrel surface of said roll is formed by said layer of steel containing carbide dispersed in a matrix having a martensite structure, the mean grain size of said carbide is not greater than 0.6 μm, and in that the areal ratio of said carbide in a matrix lies in the range of 6–30%.

12. A roll for a rolling mill according to claim 11, wherein maximum grain size of said carbide is not greater than 10 μm.

13. A roll for a rolling mill according to claim 11, wherein thickness of said layer of steel containing carbide is 1–50 mm.

14. A roll for a rolling mill according to claim 11, wherein said layer of steel containing carbide has a sleeve form and is joined with said core material by fitting.

15. A roll for a rolling mill according to claim 11, wherein said layer of steel containing carbide is composed of sintered powder body.

16. A roll for a rolling mill according to claim 11, wherein said layer of steel containing carbide is composed of a sprayed powder layer.

17. A roll for a rolling mill according to claim 11, wherein said steel core material is composed of a material having higher ductility than said steel containing carbide.

18. A roll for a rolling mill according to claim 11, wherein said steel core material is composed of a material worked out of an ingot.

19. A rolling mill having a pair of work rolls and back-up rolls supporting said work rolls, characterized in that the barrel surface of at least one of said work rolls is made of a steel containing 6–30% carbide by areal ratio, said carbide being dispersed in a matrix having a martensite structure, and that the mean grain size of said carbide is not greater than 0.6 μm.

20. A rolling mill according to claim 19, wherein said rolling mill is a Sendzimir rolling mill in which said work rolls are supported by a plurality of back-up rolls.

* * * * *